US005765820A

United States Patent [19]

Marusiak

[11] Patent Number: 5,765,820

[45] Date of Patent: Jun. 16, 1998

[54] THREE-WAY SPRING CLAMP

[76] Inventor: Frank Marusiak, 701 Kline Pl., Bridgewater, N.J. 08807

[21] Appl. No.: 516,424

[22] Filed: Aug. 17, 1995

[51] Int. Cl.[6] ..... B25B 1/00

[52] U.S. Cl. ..... 269/6; 269/3; 269/43; 269/156; 269/254 R; 269/238; 269/274

[58] Field of Search ..... 24/501, 508, 510, 24/511; 269/3, 156, 237, 274, 238, 41, 43, 254 R, 6

[56] References Cited

U.S. PATENT DOCUMENTS

| | | | |
|---|---|---|---|
| 88,390 | 3/1869 | Johnson . | |
| D. 154,898 | 8/1949 | Blackmon . | |
| D. 277,534 | 2/1985 | Warmath . | |
| D. 302,654 | 8/1989 | Cetrone . | |
| D. 317,116 | 5/1991 | Nimtz . | |
| D. 322,390 | 12/1991 | Nimtz et al. . | |
| D. 350,892 | 9/1994 | Sorensen . | |
| 488,522 | 12/1892 | Jones . | |
| 522,774 | 7/1894 | Ball | 24/511 |
| 1,542,208 | 6/1925 | Berger . | |
| 1,844,774 | 2/1932 | Locki . | |
| 2,471,606 | 5/1949 | Burns . | |
| 2,525,985 | 10/1950 | Weymouth . | |
| 2,576,904 | 11/1951 | Jessen et al. . | |
| 2,591,477 | 4/1952 | Tegarty . | |
| 2,603,849 | 7/1952 | Epperson | 24/510 |
| 2,667,678 | 2/1954 | Hargrave et al. . | |
| 2,885,758 | 5/1959 | Russo et al. . | |
| 2,913,797 | 11/1959 | Hollis et al. | 24/510 |
| 2,991,669 | 7/1961 | Stock . | |
| 3,111,296 | 11/1963 | Ludes | 24/510 |
| 3,263,535 | 8/1966 | Zurcher | 269/156 |
| 3,341,909 | 9/1967 | Havener . | |
| 3,348,275 | 10/1967 | Lawrence . | |
| 3,402,442 | 9/1968 | Kruger et al. . | |
| 3,456,262 | 7/1969 | Coon . | |
| 3,579,751 | 5/1971 | Jonckheere . | |
| 3,630,391 | 12/1971 | Wilson . | |
| 3,779,108 | 12/1973 | Reiter . | |
| 3,934,316 | 1/1976 | Driscoll . | |
| 4,063,333 | 12/1977 | Schweitzer . | |
| 4,071,930 | 2/1978 | Tanaka . | |

(List continued on next page.)

FOREIGN PATENT DOCUMENTS

| | | | |
|---|---|---|---|
| 1 391 713 | 2/1965 | France . | |
| 349734 | 3/1922 | Germany | 24/510 |
| 398487 | 7/1924 | Germany . | |
| 796846 | 6/1958 | United Kingdom . | |

OTHER PUBLICATIONS

American Clamping Corp. Catalog (no date available), p. 7.

Adjustable Clamp Company Condensed Catalog No. L-20 (no date available), pp. 3 and 6.

*Primary Examiner*—Robert C. Watson

*Attorney, Agent, or Firm*—Gibbons, Del Deo, Dolan, Griffinger & Vecchione

[57] ABSTRACT

A three-way spring clamp is provided that is useable as an edge clamp for applying clamping forces to workpieces in three directions. The clamp includes two lever arms, each having a jaw end and a handle end. The lever arms are pivotally connected to each other at a pivot point located between the jaw ends and the handle ends such that the lever arms can be moved between a closed gripping position in which the jaw ends are proximate to each other, and an opened position in which the jaw ends are spaced apart. A coil spring is provided for biasing the lever arms toward the closed gripping position. A spring engagement member is mounted between the lever arms. The engagement member includes a central body portion engageable with a surface of an article to be clamped. The body portion is positioned between the pivot point and the jaw ends and may have a generally concave configuration from the perspective of the pivot point when the lever arms are in the closed gripping position. The engagement member may be configured to snap into place between the lever arms. The engagement member provides spring pressure in a direction generally perpendicular to the direction of clamping forces applied by the jaws of the clamp, making the clamp suitable for use as a three-way edge clamp.

24 Claims, 5 Drawing Sheets

U.S. PATENT DOCUMENTS 4,079,765 3/1978 Hatayan .
4,145,793 3/1979 Berlet .
4,192,441 3/1980 Batts .
4,277,864 7/1981 Orson, Sr. .
4,312,089 1/1982 Taylor .
4,395,799 8/1983 Batts .
4,506,416 3/1985 Ohminato et al. .
4,514,885 5/1985 Delahousse et al. .
4,614,008 9/1986 Brill et al. .
4,616,113 10/1986 Jank et al. .
4,658,996 4/1987 Warmath ..... 24/511
4,671,500 6/1987 Mark .
4,722,120 2/1988 Lu .
4,813,107 3/1989 Cetrone .
4,824,086 4/1989 Rickling ..... 269/156
4,834,352 5/1989 Thornton .
4,877,228 10/1989 Ripert ..... 269/156
4,925,169 5/1990 Lodrick, Sr. .
4,959,892 10/1990 Wang .
4,968,078 11/1990 Fitzwater .
4,971,055 11/1990 von Zeppelin .
4,979,703 12/1990 Fleming .
5,079,808 1/1992 Brown .
5,149,070 9/1992 Dykstra .
5,312,097 5/1994 Womack .
5,335,898 8/1994 Johnson .
5,381,989 1/1995 Jackson .

THREE-WAY SPRING CLAMP

TECHNICAL FIELD OF THE INVENTION

The present invention relates generally to clamps for holding workpieces and, more particularly, to edge clamps and spring clamps.

BACKGROUND OF THE INVENTION

Three-way C-clamps are commonly used for applying clamping forces to workpieces in three directions. The clamps are generally used as edge clamps for clamping workpieces together. Three-way C-clamps generally comprise a C-shaped frame and three clamping screws, each in threaded engagement with apertures in the frame. Clamping is accomplished by separately rotating the clamping screws into engagement with the upper and lower surfaces of one of the workpieces and with a side surface of another workpiece. Using the three-way C-clamp is a cumbersome and time consuming process because the user must adjust each of the three clamping screws separately. Additionally, use of both hands of the user is normally required: one to hold the C-frame and the other to adjust the clamping screws. A need thus exists for a three-way clamp that can be quickly and easily applied to workpieces using one hand.

SUMMARY OF THE INVENTION

A three-way spring clamp is provided that is useable as an edge clamp for applying clamping forces to workpieces in three directions. The clamp includes two lever arms, each having a jaw end and a handle end. The lever arms are pivotally connected to each other at a pivot point located between the jaw ends and the handle ends such that the lever arms can be moved between a closed gripping position in which the jaw ends are proximate to each other, and an opened position in which the jaw ends are spaced apart. A coil spring is provided for biasing the lever arms toward the closed gripping position. A spring engagement member is mounted between the lever arms. The engagement member includes a central body portion engageable with a surface of an article to be clamped. The body portion is positioned between the pivot point and the jaw ends and, in accordance with one embodiment, has a generally concave configuration from the perspective of the pivot point when the lever arms are in the closed gripping position. The engagement member provides spring pressure in a direction generally perpendicular to the direction of clamping forces applied by the jaws of the clamp, making the clamp suitable for use as a three-way edge clamp.

In accordance with another embodiment of the invention, a folding hinge-type engagement member is provided in place of the spring engagement member.

The three-way spring clamp in accordance with the invention can be quickly and easily applied to a workpiece by a user using only one hand.

The spring clamp can be easily and inexpensively manufactured. No retooling would be necessary since presently available spring clamps can be retrofitted with engagement members to form the three-way clamps.

Since many edge clamping operations require use of a clamp positioned approximately every 4–6 inches apart on the workpiece, large quantities of clamps are usually required. Thus, use of clamps in accordance with the invention would result in substantial savings of time and money.

Furthermore, the addition of the engagement member will not substantially interfere with the original use of presently available spring clamps in that clamps in accordance with the invention can be used either as three-way edge clamps or as basic two-way squeeze clamps.

BRIEF DESCRIPTION OF DRAWINGS

Like reference numerals denote like parts in the drawings.

DETAILED DESCRIPTION

Figure 1:
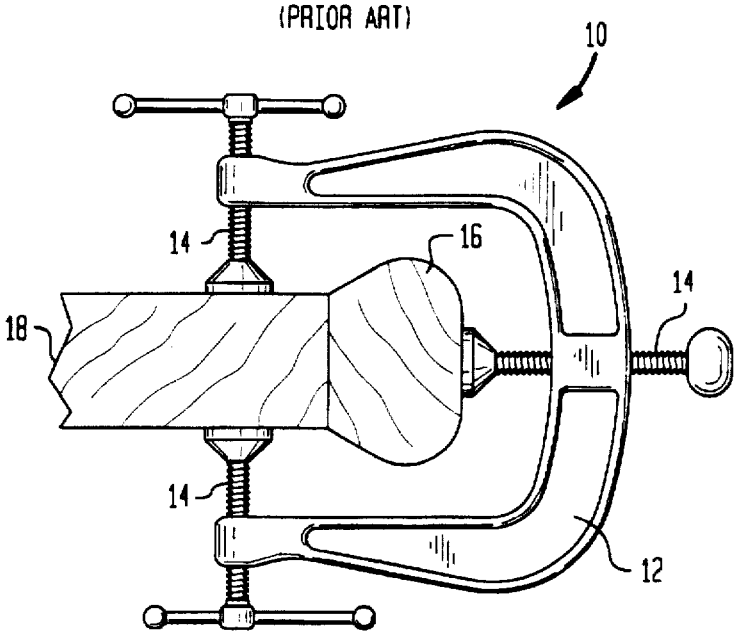
FIG. 1 (PRIOR ART)
FIG. 1 is a side view of a three-way C-clamp in accordance with the prior art.

A prior art three-way C-clamp 10 used for applying clamping forces in three directions is illustrated in FIG. 1. The three-way C-clamp 10 comprises a C-shaped frame 12 and three clamping screws 14, each in threaded engagement with apertures in the frame 12. As shown in FIG. 1, the three-way C-clamp 10 is used, for example, as an edge clamp for clamping a first workpiece, a strip of material 16, to a second larger workpiece 18. Clamping is accomplished by separately rotating each of the clamping screws 14 into engagement with the upper and lower surfaces of the workpiece 18 and with a side surface of the strip 16. Using the three-way C-clamp 10 is a cumbersome and time consuming process because the user must adjust each of the three clamping screws 14 separately. Additionally, the user must use both hands to operate the clamp, one to hold the C-frame 12 and the other to adjust the clamping s crews 14.

Figure 2:
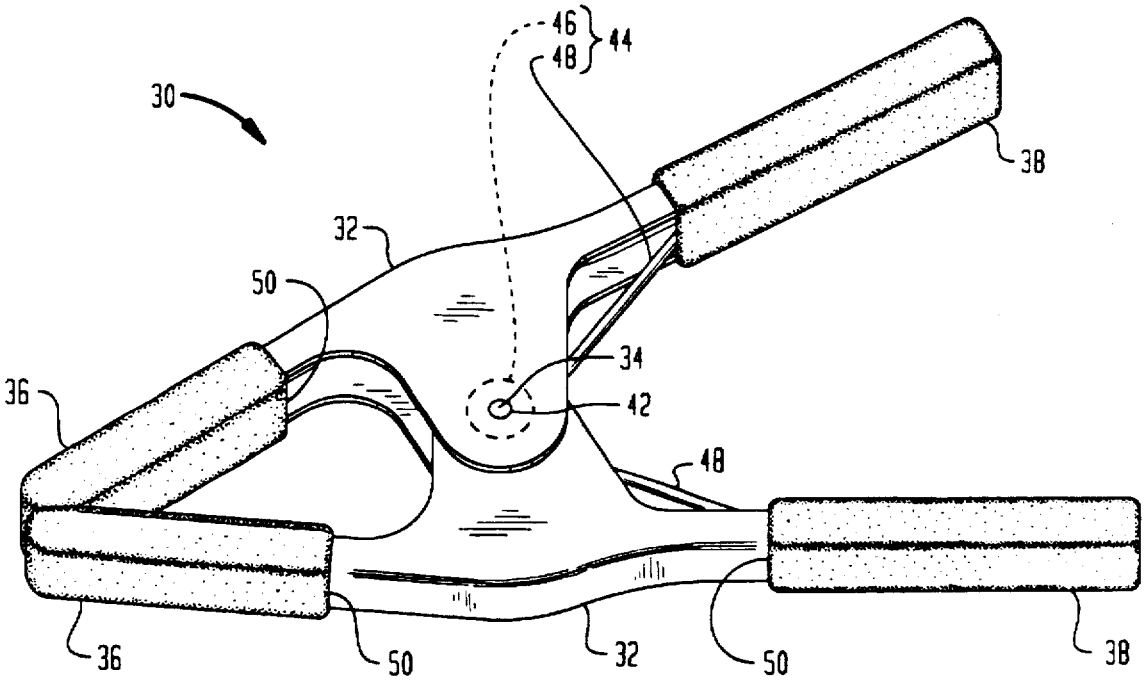
FIG. 2 (PRIOR ART)
FIG. 2 is a perspective view of a spring clamp in accordance with the prior art.

FIG. 2 illustrates a prior art spring clamp 30, sometimes called a "squeeze clamp," which is a light duty clamp that works much like a spring loaded clothespin for applying pressure to two sides of a workpiece. Such clamps can be easily and quickly applied to workpieces because they require no adjustment. Also, they can be used with only one hand, freeing the other hand to perform other tasks like, for example, holding the workpiece. Spring clamps are also inexpensive and available in several sizes, most commonly in 2", 3", and 4" sizes.

As shown in FIG. 2, the spring clamp 30 includes first and second lever arms 32 pivotally coupled to a pivot pin 34 defining a pivot point. The lever arms 32 each include a jaw end 36 and an opposite handle end 38. The central portion of each lever arm 32 includes a bracket extension 40 having a pivot pin receiving aperture 42. The brackets 40 are positioned to overlap each other such that the pivot pin receiving apertures 42 are aligned.

The clamp 30 also includes force applying means comprising a biasing helical coil spring 44 that includes a coiled portion forming a tube 46 (shown in phantom in FIG. 2) and end extensions 48 projecting from the tube 46. The tube 46 is disposed between the brackets 40 so as to align the interior of the tube 46 with the apertures 42 in the brackets 40. The pivot pin 34 extends between the apertures 42 and through the interior of the tube 46. The end extensions 48 of the spring 44 project generally away from the jaw ends 36 and engage the handle ends 38. The tension in the spring 44 biases the handle ends 38 apart and urges the jaw ends 36 toward each other in the closed gripping position illustrated in FIG. 2.

Elastomeric covers 50 can be placed over the jaw and handle ends 36, 38 of the lever arms 32. The elastomeric covers 50 are provided to furnish a comfortable grip, to electrically insulate the handle ends, and to prevent the jaw ends from marring any article held therein.

A three-way spring clamp 100, useable as an edge clamp in accordance with one embodiment of the present invention, is shown in FIGS. 3–6. The spring clamp 100 is similar to the clamp 30 of FIG. 2, but includes an additional resilient engagement member comprising a flat or plate spring 102 mounted in the clamp 100 between the lever arms 32 to provide an additional third clamping surface.

Figure 4:
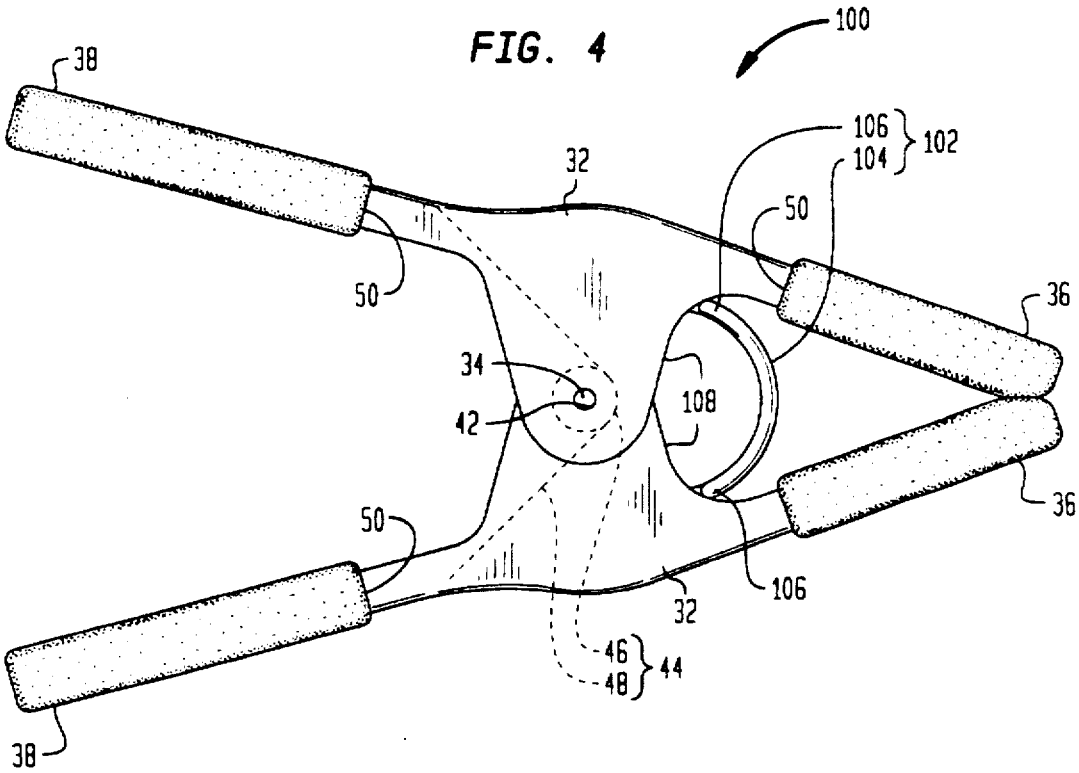
FIG. 4 is a side view of the FIG. 3 clamp shown in a closed gripping position.
Figure 5:
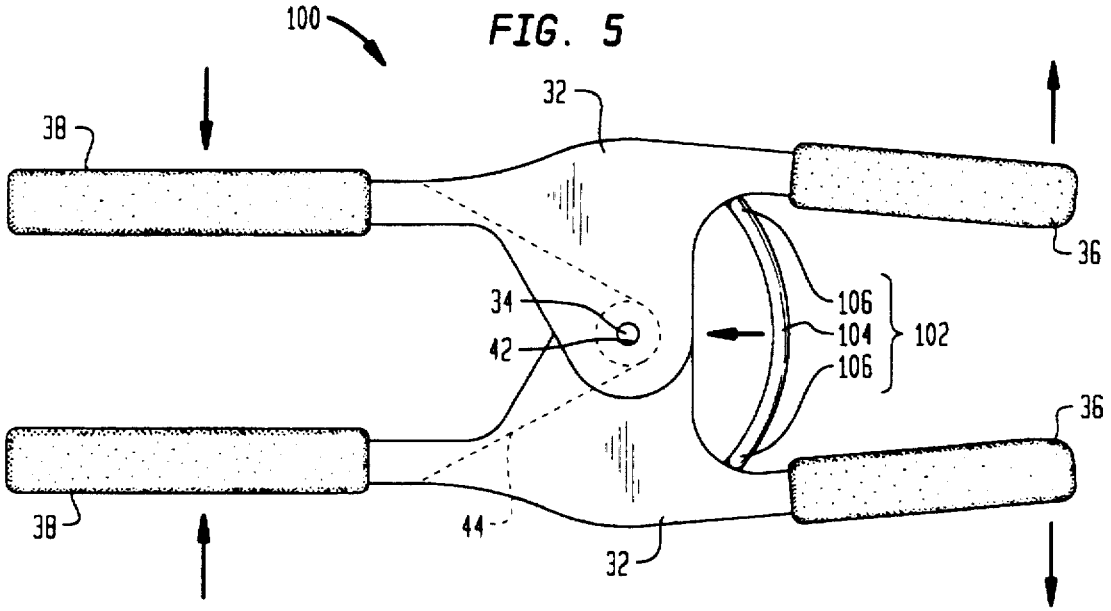
FIG. 5 is a side view of the FIG. 3 clamp shown in an opened position.

The flat spring 102 comprises a resilient elongated member having a generally flat configuration when unstressed. As shown in FIGS. 4 and 5, the flat spring comprises central body portion 104 and end portions 106 on opposite sides of the body 104. As with the jaw and handle ends 36, 38 of the lever arms 32, the body portion 104 of the flat spring 102 can be covered with an elastomeric cover to inhibit the marring of an article held by the clamp 100.

Figure 3:
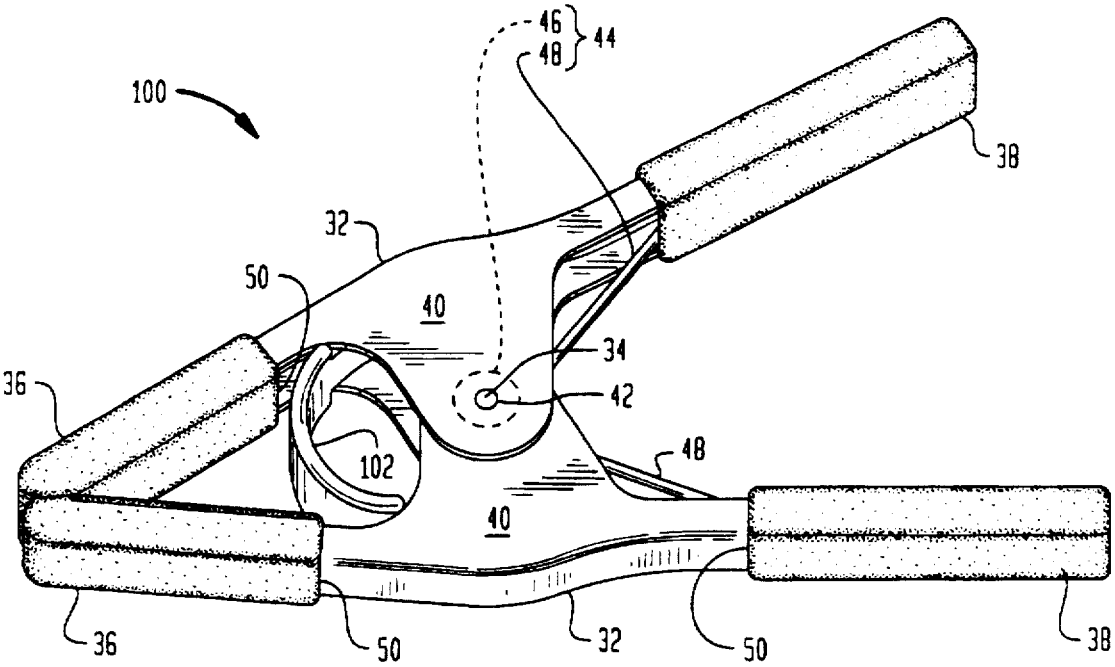
FIG. 3 is a perspective view of a three-way spring clamp in accordance with one embodiment of the present invention.

A three-way spring clamp 100 in accordance with the first embodiment is formed by fitting the flat spring 102 in a spring clamp of the type shown in FIG. 2. The spring 102 is inserted between the lever arms 32 such that the ends 106 of the spring 102 are pressed against the front edge 108 of each bracket extension 40. In FIGS. 3 and 4, the spring clamp 100 is shown in a closed gripping position where in the jaw ends 36 are in contact with each other. The flat spring 102, which has a length greater than the distance between the lever arms 32 at the brackets 40, is compressed by forces applied by the coil spring 44 and assumes a substantially curved configuration with the central body portion 104 of the spring 102 projecting towards the jaw ends 36 of the clamp 100.

When the handles 38 of the spring clamp 100 are pressed together as shown in FIG. 5, the clamp 100 moves to an opened position in which the jaws 31 are moved apart from each other. The flat spring 102 consequently resiliently changes from its distinct curved configuration of FIGS. 3 and 4 to a more flattened configuration as compression thereof by the lever arms 32 is reduced. As the flat spring 102 assumes a flatter configuration, the central body portion 104 of the spring moves away from the jaw ends 36 of the clamp and towards the pivot point 34.

Figure 6:
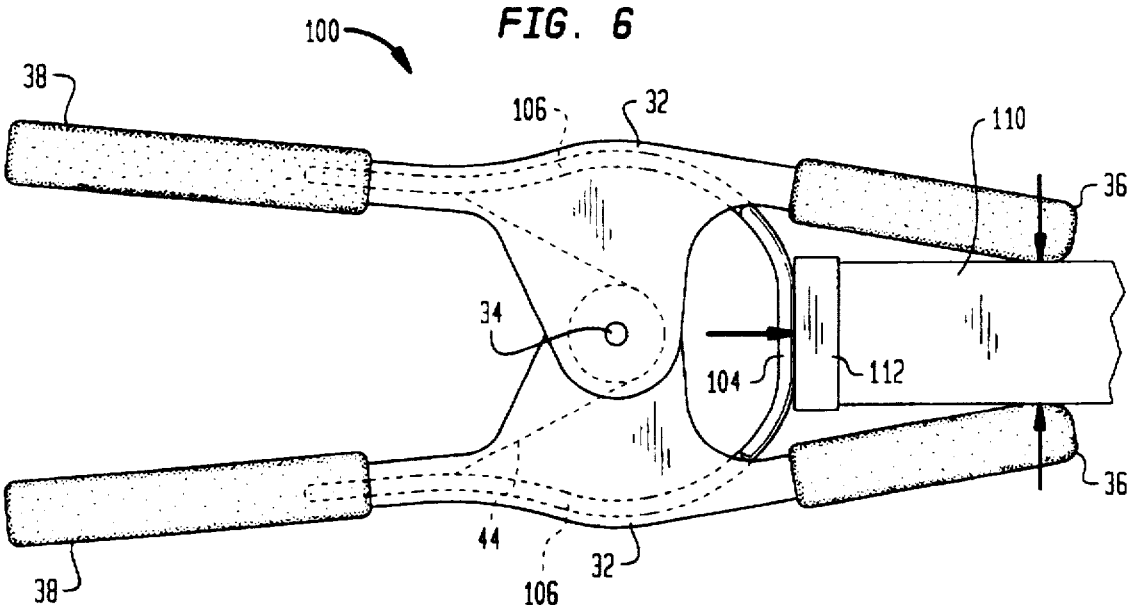
FIG. 6 is a side view of the FIG. 3 clamp shown clamped about a workpiece.

Once opened, the spring clamp 100 can be applied to a workpieces 110, 112 as shown in FIG. 6. The workpiece 110 comprises, for example, a large flat object such as a counter top. The clamp 100 can be used for example to urge the second workpiece, a strip of material 112, against an edge of the workpiece 110 to assist in, for instance, gluing the strip 112 to the workpiece 110.

The jaws 36 of the spring clamp 100 in the opened position are positioned around the strip 112 and the edge of the workpiece 110. The handles 38 are then gradually released and the jaws 36 consequently brought into engagement with the upper and lower surfaces of the workpiece 110. At the same time, the spring plate 104 moves from a flattened configuration toward a more curved configuration under compression from the lever arms 32. In the process, the central body 104 of the spring 102 moves away from the pivot point 34 towards a side surface of the strip 112. The body portion 104 is thereby brought into engagement with the strip 112 to urge the strip 112 against the workpiece 110 with resilient spring force.

Thus, a user can, with one hand, easily apply the spring clamp 100 to workpieces to provide three-way clamping pressure, making the clamp suitable for use as an edge clamp.

Figure 7:
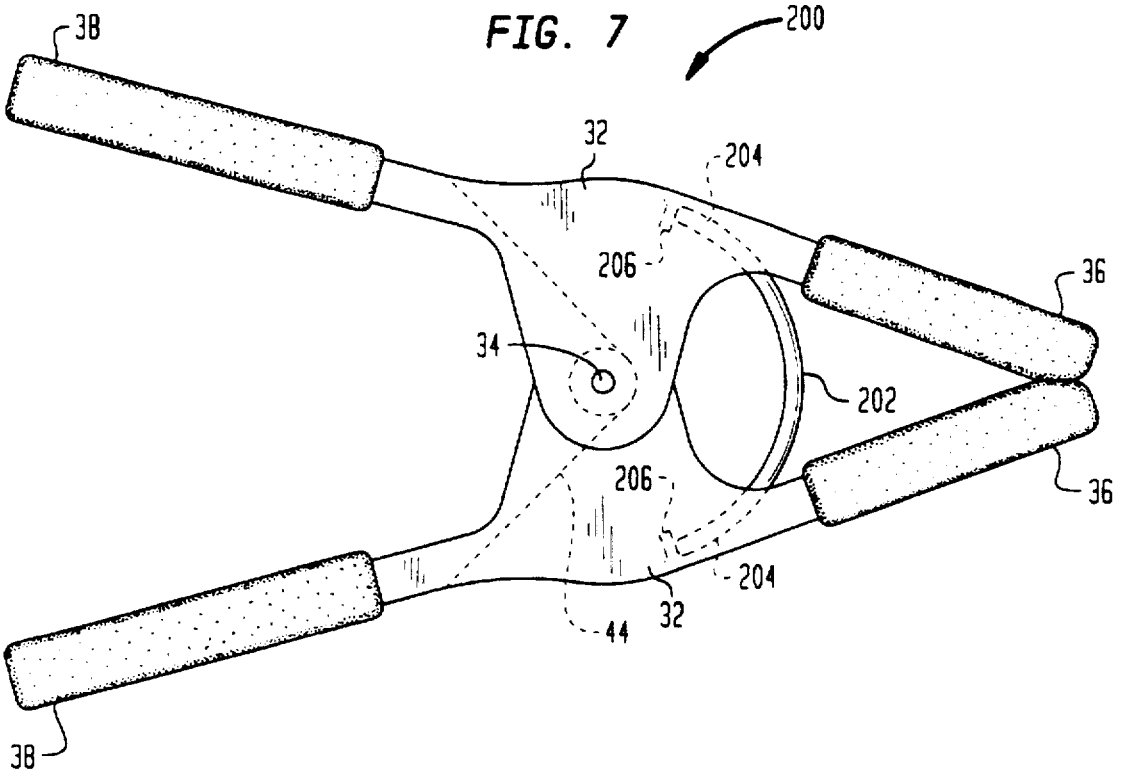
FIG. 7 is a side view of a three-way spring clamp in accordance with a preferred embodiment of the invention.

Flat springs can be retained in spring clamps in accordance with the invention by various retention means. FIG. 7 illustrates a three-way spring clamp 200 in accordance with the invention having a preferred modified flat spring 202, the ends 204 of which are secured by angled projections 206 in the lever arms 32. Flat springs may also be retained in lever arms with the use of various types of fasteners (not shown) including, for example, rivets. Additionally, holes (not shown) may be stamped into flat springs such that the springs can be snapped in place over projections in the lever arms.

Figure 8:
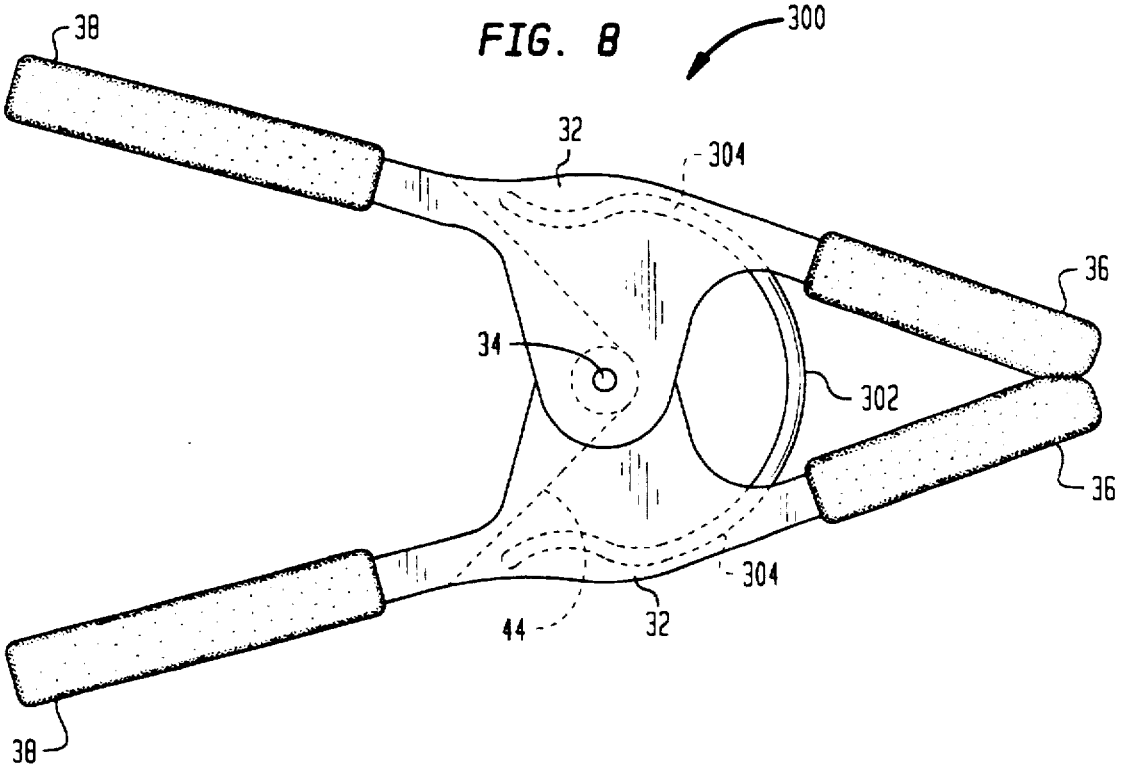
FIG. 8 is a side view of a three-way spring clamp in accordance with yet another embodiment of the invention.

In addition, as shown in the three-way spring clamp 300 of FIG. 8, a spring engagement member 302 can be provided having end portions 304 having an undulated or wavelike shape. The end portions 304 are resiliently deformable and designed to snap into place against the lever arms 32.

Thus, in accordance with the present invention, a prior art spring clamp can be easily transformed into a three-way clamp with the insertion therein of a spring engagement member. The engagement member provides spring pressure in a direction generally perpendicular to the direction of clamping forces applied by the jaws of the clamp, towards the jaw ends, making the clamp suitable for use as a three-way edge clamp.

Also, it should be noted that the addition of the engagement spring will not substantially interfere with the original use of presently available spring clamps in that the clamps in accordance with the invention can be used either as three-way edge clamps or as basic two-way squeeze clamps.

Figure 9:
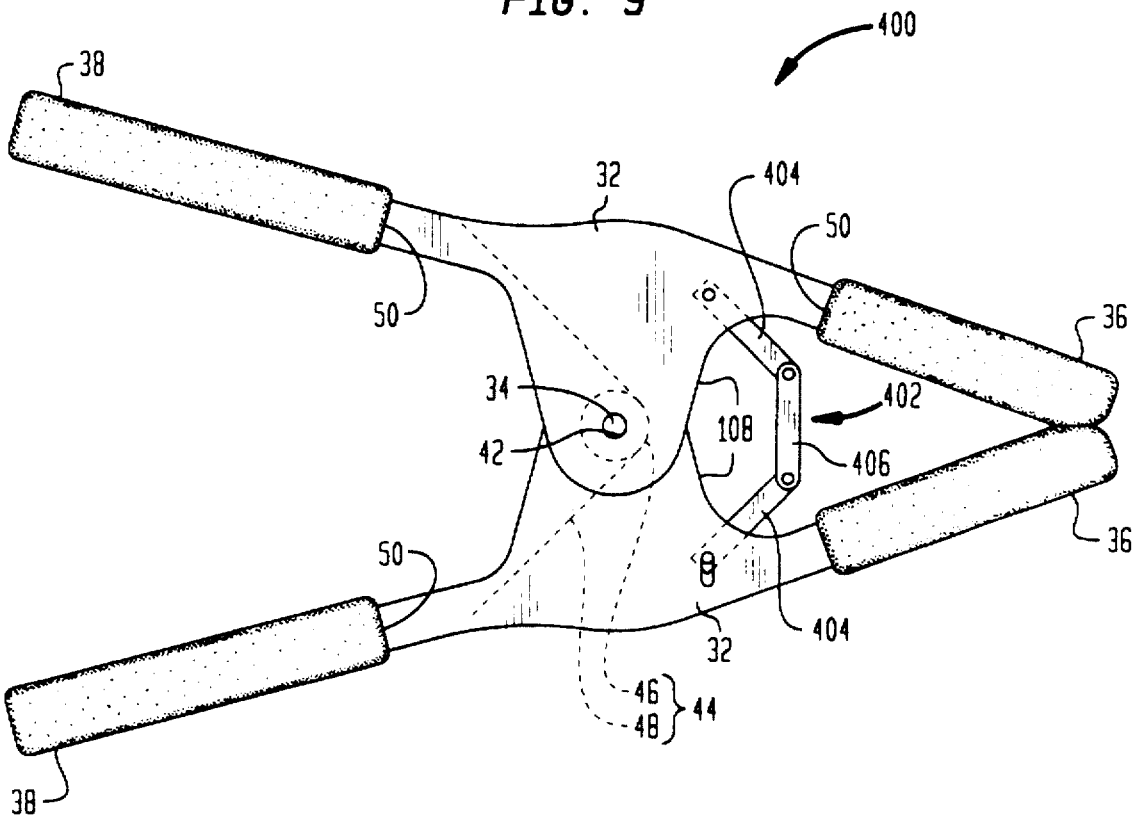
FIG. 9 is a side view of a three-way spring clamp in accordance with yet another embodiment of the invention.

FIG. 9 illustrates a three-way spring clamp 400 in accordance with yet another embodiment of the invention. In this embodiment, the engagement springs of the earlier embodiment are replaced by a collapsible member 402 comprising a folding hinge-type mechanism. The collapsible member comprises two outer bars 404 and a center bar 406. The forward ends of the outer bars are each pivotally connected to an opposite end of the center bar. The rear ends of the outer bars are pivotally connected by means of a standard pivot pin connection to the lever arms 32.

In FIG. 9, the hinge-type mechanism 402 is shown in a generally collapsed configuration. As the jaws 36 of the clamp 400 are opened, the mechanism 402 moves toward a straighter configuration. When clamped about a workpiece, the center bar 406 engages a side surface of the workpiece, providing three-way clamping action. While not shown, it should be understood that collapsible mechanisms of various configurations can be used to provide the third engagement surface of the clamp.

The present invention has been described in the foregoing specification with respect to specific embodiments. These embodiments serve as examples to illustrate the invention rather than to limit its scope. Modifications may be made thereto without departing from the broader teachings of the invention.

I claim:

1. A three-way clamp, comprising:

two lever arms, each including a jaw end and a handle end, said lever arms being pivotally connected to each other at a pivot point located between said jaw end and said handle ends such that said lever arms can be moved between a closed gripping position in which said jaw ends are proximate each other and an opened position in which said jaw ends are spaced apart;

a biasing spring for biasing said lever arms toward the closed gripping position providing a clamping force applied by said jaw ends; and a resilient engagement member mounted between said lever arms, said resilient engagement member includes a central body portion engageable with a surface of an article to be clamped, said body portion positioned between said pivot point and said jaw ends, said resilient engagement member comprises two end portions each on an opposite side of said central body portion, wherein each said end portion engages a different one of said lever arms and said resilient engagement member provides spring pressure in a direction generally perpendicular to said clamping force.

2. The three-way spring clamp of claim 1, wherein said resilient engagement member comprises a flat type spring.

3. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart;

a biasing spring for biasing said lever arms toward the closed gripping position; and a resilient engagement member mounted between said lever arms, said resilient engagement member including a central body portion engageable with a surface of an article to be clamped, said body portion positioned between said pivot point and said jaw ends, wherein said resilient engagement member comprises two end portions each on an opposite side of said central body portion, wherein each said end portion engages a different one of said lever arms and each said end portion has an undulated shape.

4. The three-way spring clamp of claim 1, wherein each lever arm includes a projection therein, and each end portion engages one of said projections.

5. The three-way spring clamp of claim 1, wherein each end portion is riveted to one of said lever arms.

6. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart;

a biasing spring for biasing said lever arms toward the closed gripping position; and a resilient engagement member mounted between said lever arms, said resilient engagement member including a central body portion engageable with a surface of an article to be clamped, said body portion positioned between said pivot point and said jaw ends, wherein said resilient engagement member is configured to snap into position between said lever arms.

7. The three-way spring clamp of claim 1, wherein said biasing spring comprises a coil spring.

8. The three-way spring clamp of claim 1, further comprising an elastomeric cover covering said central body portion to inhibit marring of said surface of said article to be clamped.

9. The three-way spring clamp of claim 1, further comprising elastomeric covers covering said jaw ends and said handle ends of said lever arms.

10. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart;

biasing means for biasing said lever arms toward the closed gripping position providing a clamping force applied by said jaw ends; and a spring engagement member mounted between said lever arms, said spring engagement member including a central body portion engageable with a surface of an article to be clamped, said body portion positioned between said pivot point and said jaw ends, said body portion also having a generally concave configuration from the perspective of said pivot point when said lever arms are in the closed gripping position, wherein said spring engagement member provides spring pressure in a direction generally perpendicular to said clamping force.

11. The three-way spring clamp of claim 10, wherein said spring engagement member comprises a normally flat type spring.

12. The three-way spring clamp of claim 10, wherein said spring engagement member comprises two end portions each on an opposite side of said central body portion, wherein each said end portion engages a different one of said lever arms.

13. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart;

biasing means for biasing said lever arms toward the closed gripping position; and a spring engagement member mounted between said lever arms, said spring engagement member including a central body portion engageable with a surface of an article to be clamped, said body portion positioned between said pivot point and said jaw ends, said body portion also having a generally concave configuration from the perspective of said pivot point when said lever arms are in the closed gripping position, wherein said spring engagement member comprises two end portions each on an opposite side of said central body portion, wherein each said end portion engages a different one of said lever arms and each said end portion has an undulated shape.

14. The three-way spring clamp of claim 12, wherein each lever arm includes a projection therein, and each end portion engages one of said projections.

15. The three-way spring clamp of claim 12, wherein each end portion is riveted to one of said lever arms.

16. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart;

biasing means for biasing said lever arms toward the closed gripping position; and a spring engagement member mounted between said lever arms, said spring engagement member including a central body portion engageable with a surface of an article to be clamped, said body portion positioned between said pivot point and said jaw ends, said body portion also having a generally concave configuration from the perspective of said pivot point when said lever arms are in the closed gripping position, said spring engagement member is configured to snap into place between said lever arms.

17. The three-way spring clamp of claim 10, further comprising an elastomeric cover covering said central body portion to inhibit marring of said surface of said article to be clamped.

18. The three-way spring clamp of claim 10, further comprising elastomeric covers covering said jaw ends and said handle ends of said lever arms.

19. A three-way spring clamp comprising:

two lever arms, each including a jaw end and a handle end, said lever arms being pivotally connected to each other at a pivot point located between said jaw end and said handle ends such that said lever arms can be moved between a closed gripping position in which said jaw ends are proximate each other and an opened position in which said jaw ends are spaced apart;

a biasing spring for biasing said lever arms toward the closed gripping position providing a clamping force applied by said jaw ends; and, an engagement member comprises a collapsible member and said engagement member mounted between said lever arms, said engagement member includes a central body portion engageable with a surface of an article to be clamped, said body portion positioned between said pivot point and said jaw ends, wherein said engagement member provides spring pressure in a direction generally perpendicular to said clamping force.

20. A three-way spring clamp, comprising:

two lever arms, each including a jaw end and a handle end, said lever arms being pivotally connected to each other at a pivot point located between said jaw ends and said handle ends such that said lever arms can be moved between a closed gripping position in which said jaw ends are proximate each other and an opened position in which said jaw ends are spaced apart:

a biasing spring for biasing said lever arms toward the closed gripping position: and an engagement member mounted between said lever arms, said engagement member including a central body portion engageable with a surface of an article to be clamped, said body portion positioned between said pivot point and said jaw ends, wherein said engagement member comprises a collapsible member, said collapsible member includes a folding hinge-type mechanism.

21. The three-way spring clamp of claim 20, wherein said folding hinge-type mechanism comprises a center bar and two outer bars, wherein forward ends of said outer bars are each pivotally connected to an opposite end of said center bar, and rear ends of said outer bars are each pivotally connected to a different one of said lever arms.

22. The three-way spring clamp of claim 19, wherein said biasing spring comprises a coil spring.

23. The three-way spring clamp of claim 19, further comprising an elastomeric cover covering said central body portion to inhibit marring of said surface of said article to be clamped.

24. The three-way spring clamp of claim 19, further comprising elastomeric covers covering said jaw ends and said handle ends of said lever arms.

* * * * *